United States Patent [19]

Mohr

[11] 3,984,738

[45] Oct. 5, 1976

[54] PIEZOELECTRIC IGNITER FOR LIGHTERS

[75] Inventor: Walter Mohr, Frankfurt am Main, Germany

[73] Assignee: Braun Aktiengesellschaft, Frankfurt am Main, Germany

[22] Filed: May 14, 1974

[21] Appl. No.: 469,747

[30] Foreign Application Priority Data

| | | |
|---|---|---|
| May 14, 1973 | Germany | 2324228 |
| May 14, 1973 | Germany | 2324230 |
| Aug. 16, 1973 | Germany | 2341475 |
| Aug. 16, 1973 | Germany | 2341523 |

[52] U.S. Cl. ..... 317/81; 310/8.7; 317/DIG. 11; 431/255

[51] Int. Cl.[2] ..... H01L 41/04; F23Q 3/00

[58] Field of Search ..... 317/81, DIG. 11, 79; 310/8.3, 8.7; 431/255

[56] References Cited

UNITED STATES PATENTS

| | | | |
|---|---|---|---|
| 2,649,488 | 8/1953 | Harkness | 317/DIG. 11 |
| 3,344,314 | 9/1967 | Koontz | 317/81 |
| 3,349,709 | 10/1967 | Vilbajo | 317/DIG. 11 |
| 3,384,786 | 5/1968 | Oyamada et al. | 317/81 X |
| 3,396,311 | 8/1968 | Maltner et al. | 317/81 |
| 3,428,408 | 2/1969 | Ameyama et al. | 431/255 |
| 3,457,461 | 7/1969 | Steinke et al. | 317/81 |
| 3,486,075 | 12/1969 | Steinke et al. | 317/81 |
| 3,540,823 | 11/1970 | Ebine et al. | 431/255 |
| 3,576,383 | 4/1971 | Fuller et al. | 431/255 |
| 3,586,888 | 6/1971 | Dorfman | 310/8.3 |
| 3,622,258 | 11/1971 | Goto | 431/255 |
| 3,758,827 | 9/1973 | Schroder et al. | 317/81 |
| 3,793,561 | 2/1974 | Lundh | 317/81 |

FOREIGN PATENTS OR APPLICATIONS

| | | | |
|---|---|---|---|
| 1,036,030 | 7/1966 | Canada | 317/81 |

*Primary Examiner*—A. Bartis
*Attorney, Agent, or Firm*—Frederick E. Bartholy

[57] ABSTRACT

An igniter utilizing a piezoelectric transducer intended particularly for lighters is described. It consists of a tubular housing of plastic material. Placed in the bottom of the housing, and loosely fitting therein, are a pair of barium titanate crystals stacked one over the other with a contacting electrode. A striking hammer is suspended above the crystals and held by the magnetic force of a permanent magnet. A spring acting on the hammer is arranged to be compressed by an actuating cap. Upon such compression of the spring which overcomes the retentive force of the magnet, the hammer is propelled against the transducer, thereby creating the generation of an electric potential used to provide an igniting spark. A spring plate placed between the bottom of the housing and the crystals. The spring pressure of the spring plate on the crystals is adjusted by a screw seated in the bottom of the housing.

3 Claims, 4 Drawing Figures

PIEZOELECTRIC IGNITER FOR LIGHTERS

BACKGROUND OF THE INVENTION

The invention relates to an igniter with a striking mechanism, especially for lighters, having a piezoelectric transducer and a hammer which is movable in the direction of the latter and which co-operates with an energy storing spring. This spring can be compressed by an actuating member. A movement release device is provided for the hammer. A housing is provided which receives these parts.

Piezoelectric igniters are already known. However, they have the disadvantage that for the generation of the ignition energy comparatively large sizes are needed which are not suitable for pocket lighters.

SUMMARY OF THE INVENTION

It is an object of the present invention to provide a piezoelectric igniter of this type which is smaller than the known piezoelectric igniters and the manufacture of which is simpler.

It is a further object to provide such an igniter that has a high efficiency of converting mechanical energy into electrical energy and that is also dust-proof.

According to the invention, the solution of this problem resides in that the housing is made of plastic material and that the crystal elements of the piezoelectric transducer are inserted directly into the housing.

The hitherto customary additional housing for the piezoelectric transducer can thus be dispensed with. Such a construction for generating the minimum ignition energy for lighters has a smaller space requirement and the duration of the spark is longer. Thus no compensating resistance has to be used in the ignition line.

The crystal elements inserted in the housing have some lateral movement. By this means it is ensured that the striking energy acts on the transducer in the axial direction and is not minimized by friction at the housing wall.

The crystal elements may be mechanically biased by a return spring which is arranged between the hammer and a front surface of the piezoelectric transducer. This brings about an intimate contact of the structural parts so that the striking energy is transformed into electric energy in the most efficient way. The return spring is further compressed during the hammer movement, so that the pressure exerted on the structural parts of the piezoelectric transducer is greatest shortly before the impact of the hammer.

According to one embodiment, a spring plate is situated between the bottom surface of the piezoelectric transducer and the adjoining end of the housing. The piezoelectric transducer abuts with the end thereof facing the hammer against a shoulder which is fixed in the housing, and the spring plate is biased via a tensioning screw which is seated in the housing. By this means the bias of the spring plate and thus the spring constant can be adjusted in a simple manner.

According to another embodiment, the bottom of the plastic housing which is in contact with the piezoelectric transducer is arched towards the inside.

It is particularly advantageous to provide the movement release device as a magnetic circuit, in order to reduce the number of parts of the movement release device to a minimum.

DETAILED DESCRIPTION OF THE EMBODIMENTS

Figure 1:
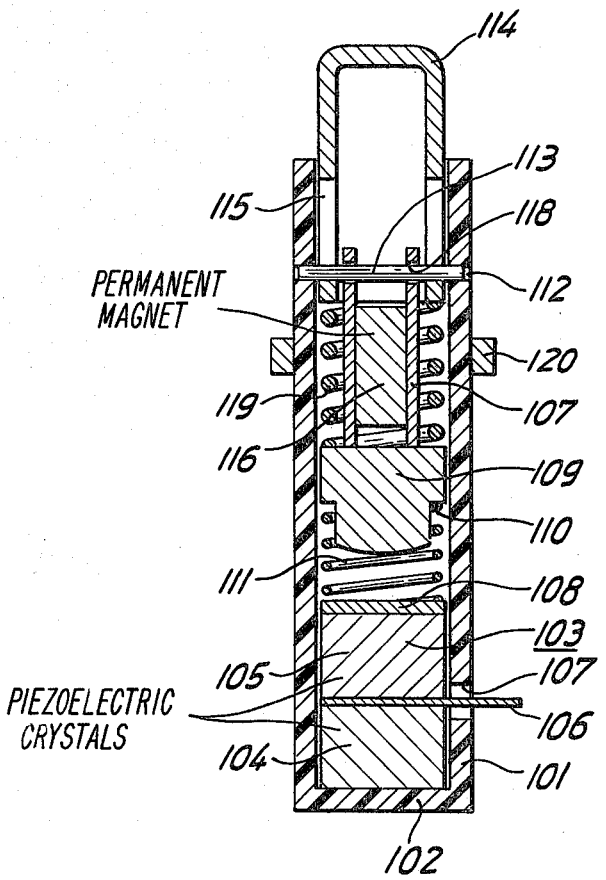
FIG. 1 is a longitudinal sectional view of a piezoelectric igniter according to the invention.
Figure 2:
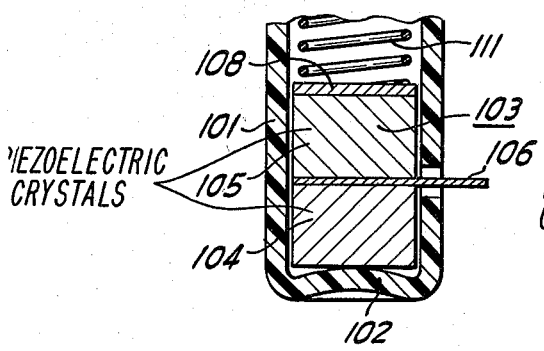
FIG. 2 is a longitudinal sectional view of a portion of one embodiment of the present invention showing the piezoelectric transducer and the bottom of the housing.
Figure 3:
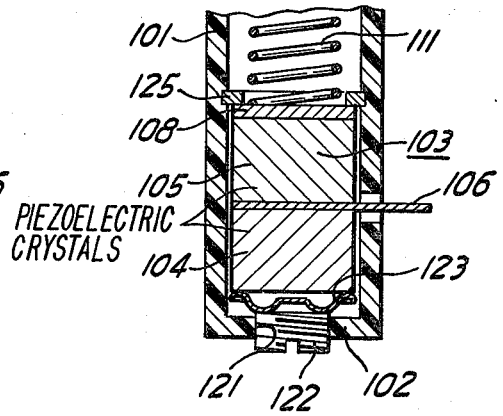
FIG. 3 is a longitudinal sectional view of a portion of another embodiment of the present invention showing the piezoelecric transducer and the bottom of the housing.

Referring to FIGS. 1, 2 and 3, the igniter comprises a cylindrical housing 101 made of a plastic material. The housing has a circular cross-section and is closed at one end by a bottom 102. The interior of the housing is likewise shaped. Resting on the bottom 102 of the housing is a piezoelectric transducer 103, having two piezoelectric barium titanate crystals 104 and 105 which are arranged in series and between which there is an electrode 106 which is led towards the outside through an aperture 107 in the housing wall. A bounce plate 108 made of metal is situated on the top barium titanate body 105. Said bounce plate is bonded to the barium titanate body.

The piezoelectric igniter furthermore comprises a hammer 109 which is provided, at the region pointing towards the bounce plate, with a circumferential recess which ends at a shoulder 110. A return spring 111, which has end faces ground in plane parallel manner, is disposed between the bounce plate 108 and the shoulder 110.

At the open top end of the housing 101 there are diametrically opposite bores 112, through which a holding pin 113 is driven, which serves for holding an actuating cap 114 and a permanent magnet arrangement.

The actuating cap 114 is cup-shaped and comprises two diametrically opposite, paraxially extending longitudinal slots 115, through which the holding pin 113 is placed. The longitudinal slots allow a movability of the actuating cap 114 which corresponds to the length of said slots. The cap has an external diameter which is somewhat smaller than the internal diameter of the housing 101, so that the actuating cap cannot be substantially tilted. The permanent magnet arrangement comprises a parallelepiped-shaped magnet 116, at the two opposite longitudinal sides of which pole plate 117 are fitted which project, on both sides, somewhat beyond the length of the permanent magnet 116. The pole plates 117 are glued to the permanent magnet 116.

The ends of the pole plates 117 which protrude beyond the top are provided with bores 118, through which the holding pin 113 is placed. In this way the permanent magnet arrangement, consisting of the parts 116 and 117, is fixedly held in the housing.

The lower ends of the pole plates 117 abut against a front surface of the hammer 109, which consists of a ferromagnetic material and is therefore retained by the magnetic flux.

The piezoelectric igniter comprises furthermore an energy storing or compression spring 119 which acts on the rear surface of the hammer 109, on the one hand, and on the front edge of the open end of the actuating cap 114, on the other hand.

The housing comprises, in its upper region, a torus 120 which serves for fastening the piezoelectric igniter, for instance, in a lighter. The thickness and the material of the housing 101 are selected in such a way that a desired spring constant of the housing 101 between the torus 120 and the contact surface of the piezoelectric transducer 103 results. By this means it is achieved that the force of the hammer acts on the piezoelectric transducer 103 for a longer time span and that there results a higher ignition energy in comparison to a conventional piezoelectric igniter not incorporating the features according to the invention.

The piezoelectric igniter has the following mode of operation. In the rest position shown in FIG. 1, the energy storing spring 119 is practically in its relaxed state, so that it does not exert any substantial force on the hammer 109. If the actuating cap 114 is now pressed downwards, the energy storing spring 119 is compressed and, accordingly, an increasing force is exerted on the hammer 109. As soon as the compressive force of the energy storing spring 119 exceeds the retaining force of the permanent magnet arrangement, the hammer detaches itself from the same and is impelled downwards against the bounce plate 108, the return spring 111 already exerting a pressure on the piezoelectric transducer before the hammer 109 impinges on the bounce plate 108. In any case, the individual parts of the piezoelectric transducer are compressed by the action of the return spring to such an extent that they no longer rest against one another loosely or with play. By compressing the piezoelectric transducer before the impact of the hammer it is achieved that the piezoelectric transducer generates a maximum electric energy upon the impact of the hammer.

The circumferential recess at the generated surface of the hammer 109 allows a reception of the return spring 111 in the compressed state of the same, i.e. when the hammer 109 impinges on the bounce plate 108.

Instead of the torus 120, any other fastening or holding device may be used for the housing of the piezoelectric igniter.

FIG. 2 shows an axial section of the lower part of a modified igniter according to the invention. The bottom 102 of the housing 101 is convex towards the inside, and the lower crystal 104 is in point contact with the convex bottom 102. A desired spring constant can be adjusted by the extent of the curvature, the thickness of the bottom and the material of the housing 101.

FIG. 3 shows, in an axial section, the lower region of a further embodiment. The bottom 102 of the housing 101 is provided with an opening 121 which accommodates a threaded plug or screw 122. Disposed between the threaded plug and the transducer 103 is a spring plate 123, the spring pressure of which may be adjusted. This is accomplished in that the spring plate 123 is ring-shaped and has an arched surface, so that the threaded plug 122 may compress the spring plate 123.

The pressure exerted by the spring plate 123 on the piezoelectric transducer is received by an annular shoulder 125 on the inner side of the housing 101.

However, the variability of the spring constant as a function of the bias can also be achieved in a manner that is different from the one known 'per se,' for instance by a multi-load spring plate or by a conical spring having a progressive pitch.

Figure 4:
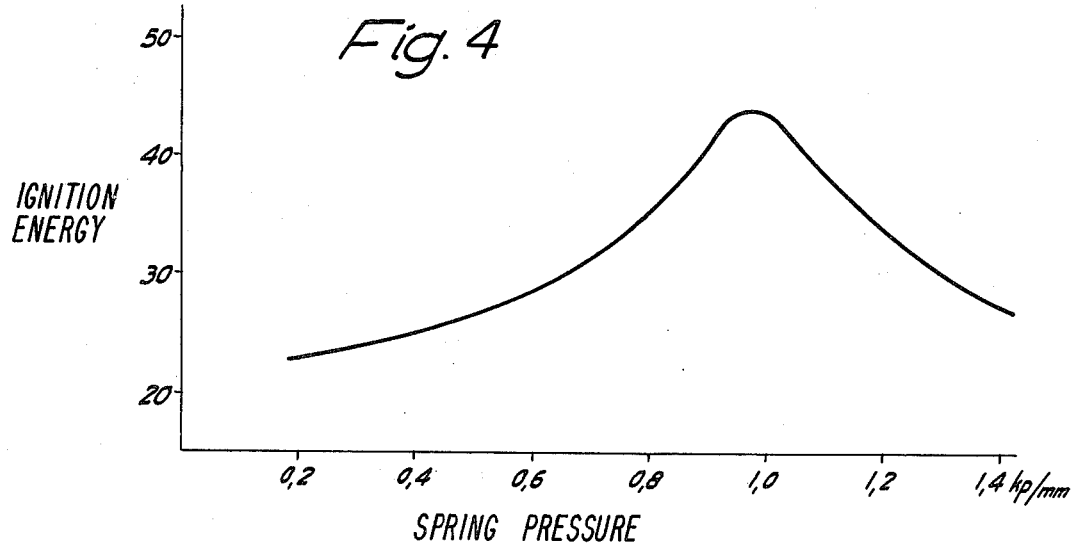
FIG. 4 is a graphical representation which shows the dependence of the ignition energy on the spring constant.

FIG. 4 is a curve showing the ignition energy plotted versus the spring pressure between the fastening point of the housing 101 and the supported surface 124 of the transducer. The ordinate shows the scale division of a fluxmeter, one scale division corresponding to $5 \cdot 10^{-6}$ Vsec. Experiments have shown that the greatest ignition energy is brought about at a spring pressure of 0.97 kp/mm.

I claim:

1. A piezoelectric igniter for lighters comprising a hollow housing having a closed bottom, a piezoelectric transducer positioned adjacent the bottom of said housing, a spring biased hammer axially movably guided in said housing for movement toward said transducer, means for retaining said hammer in a first position spaced with respect to said piezoelecric transducer, means for releasing said hammer from said first position for movement of said hammer towards impact with said piezoelectric transducer, a return spring placed between said hammer and the upper surface of said piezoelectric transducer, said return spring adapted to return said hammer to said first position and to preload said piezoelectric transducer, a spring plate placed between the bottom surface of said piezoelectric transducer and the bottom of said housing and a screw seated in the bottom of said housing, said screw being in contact with said spring plate for compressing said spring plate to adjust the amount of preloading on said piezoelectric transducer.

2. A piezoelectric igniter in accordance with claim 1 further including a shoulder provided on the inside surface of said housing, said shoulder adapted to contact the upper surface of said piezoelectric transducer.

3. A piezoelectric igniter in accordance with claim 2 wherein said piezoelectric transducer comprises two crystals placed on top of one another.

* * * * *